US006899296B2

(12) United States Patent
Kansaku et al.

(10) Patent No.: US 6,899,296 B2
(45) Date of Patent: May 31, 2005

(54) PAPER SPLICING DEVICE

(75) Inventors: Toshio Kansaku, Kanagawa-ken (JP); Yukio Ogawa, Kanagawa-ken (JP); Daisuke Nakamura, Kanagawa-ken (JP); Yoshihiko Murata, Kanagawa-ken (JP)

(73) Assignee: Kabushiki Kaisha Tokyo Kikai Seisakusho, Tokyo (JP)

( * ) Notice: Subject to any disclaimer, the term of this patent is extended or adjusted under 35 U.S.C. 154(b) by 135 days.

(21) Appl. No.: 10/228,082

(22) Filed: Aug. 27, 2002

(65) Prior Publication Data

US 2003/0126970 A1 Jul. 10, 2003

(30) Foreign Application Priority Data

Jan. 8, 2002 (JP) ..... 2002-001360

(51) Int. Cl.[7] ..... B65H 19/18
(52) U.S. Cl. ..... 242/555.5
(58) Field of Search ..... 242/555.3, 555.4, 242/555.5, 555.6, 555.7

(56) References Cited

U.S. PATENT DOCUMENTS

| | | | | |
|---|---|---|---|---|
| 3,861,612 A | * | 1/1975 | Kubo | 242/555.6 |
| 5,360,181 A | * | 11/1994 | Hayashi et al. | 242/555.6 |
| 6,019,307 A | * | 2/2000 | Souma | 242/555.6 |

FOREIGN PATENT DOCUMENTS

| | | | |
|---|---|---|---|
| JP | 64-55349 | 4/1989 | |
| JP | 04-197954 | 7/1992 | |
| JP | 5-338876 | * 12/1993 | 242/555.6 |
| JP | 6-071954 | 9/1994 | |
| JP | 11-091997 | 4/1999 | |
| JP | 2929376 | 5/1999 | |
| JP | 2000-24723 | 1/2000 | |

* cited by examiner

*Primary Examiner*—John M. Jillions
(74) *Attorney, Agent, or Firm*—Foley & Lardner LLP

(57) ABSTRACT

In order to resolve problems where impact force when a pushing member of a splicing device collides becomes large, strength becomes inconsistent as a result of a pushing force due to reactive force, and paper splicing becomes unstable due to it taking time to suppress this, with paper splicing precision falling as a result, a paper splicing device is provided with a pressing member for pressing running paper web taken from one paper roll against the peripheral surface of a paper roll rotatably driven in such a manner that the peripheral surface moves at substantially the same speed as the speed of running of the paper web. The paper splicing device has pressing means for pressing and actuating the pressing member so as to press the paper web against the peripheral surface of the paper roll, and at least one shock absorbing means provided facing the direction of operation of a member coupling as a result of a pressing operation of the pressing means and being capable of absorbing an impact when the paper web is pressed against the peripheral surface of the paper roll.

7 Claims, 9 Drawing Sheets

PAPER SPLICING DEVICE

BACKGROUND OF THE INVENTION

1. Field of the Invention

The present invention relates to a paper splicing device for splicing paper at a paper feeder of a rotary press for continually supplying paper by splicing paper web, i.e. a so-called "on the fly" paper splicing device. With on the fly splicing devices, pasting units for paper splicing are provided using adhesive or double-sided adhesive tape at the surface at the lead edge of the paper in order to splice the paper. A paper roll where this lead edge is held on standby in such a manner that the lead edge is temporarily tacked against the peripheral surface is then driven to rotate so that the peripheral surface moves at substantially the same speed as paper web when the paper web is being consumed, and the paper web being consumed is made to make contact with the lead edge of the rotatably driven paper roll by the pressing member and is spliced.

2. Description of the Background

With related paper web splicing devices, the pressing member pressed by the pressing means moves in the direction of the peripheral surface of the paper roll, and the pressing member rebounds due to the reactive force due to the impact of the pressing member after the pressing member collides via the running paper web. This rebounding is repeated, and it therefore takes time until the pressing member stops in a stable state with the pressing force being appropriate. The pressing force of the pressing member for pressing the running paper web onto the peripheral surface of the paper roll is therefore of an inconsistent strength, which in turn causes the paper splicing to malfunction. FIG. 9 is a graph showing the relationship between displacement and time elapsed for a pressing member of this kind of related paper splicing device.

Paper splicing devices having means for suppressing rebounding due to the pressing impact of the pressing member on the surface of the paper roll have been considered in order to resolve these problems, and have been made public as shown in Japanese Laid-open Patent Publication Hei. 6-71954 (related art 1) and Japanese Patent Publication No. 2929376 (related art 2).

The paper splicing device shown in related art 1 comprises a first pressing means provided linked with a pressing member and a coupling member supporting the pressing member, the pressing member being made to move by the operation of the coupling member, and a second pressing means provided connected to the coupling member, acting after the action of the first pressing means, and suppressing rebounding of the pressing member made to move by the first pressing means.

The first pressing means of related art 1 rapidly moves the pressing member towards the running paper web so that the running paper web is pressed against the peripheral surface of the rotatably driven paper roll. The second pressing means is also provided to prevent rebounding of the pressing member occurring while the pressing member collides with the peripheral surface of the paper roll during pressing of the paper web. The second pressing means acts to suppress rebounding of the pressing member from the peripheral surface of the paper roll after the pressing member is made to collide with the paper roll by the first pressing means.

The paper splicing device shown in related art 2 comprises a pressing member and a coupling member supporting the pressing member, first pressing means provided linked with the coupling means and causing the pressing member to move as a result of the action of the coupling member, and damping means, provided in the vicinity of a shaft causing the pressing member to move using angular displacement within the coupling member, and coming into contact with this shaft when the shaft is elastically deformed so as to act to dampen angular displacement of the shaft. In addition to this configuration there is also further provided second pressing means provided so as to be coupled with the coupling member and acting after the action of the first pressing means, so as to reinforce the pressing force of the pressing member caused to move by the first pressing means.

The first pressing means of related art 2 rapidly moves the pressing member towards the running paper web so that the running paper web is pressed against the peripheral surface of the rotatably driven paper roll. When the paper web is pressed, the pressing member first makes contact with the running paper web, a force is then exerted from the paper web in the direction of running of the paper web, and the shaft within the coupling member then elastically deforms as a result of this force, making contact with the damping member of the damping means. The pressing member then collides with the surface of the paper roll so as to bring about a reactive force. The pressing member therefore attempts to rebound due to this reactive force but frictional force acts between the shaft within the coupling member and the damping member so as to suppress the angle of displacement between this shaft and the pressing member.

With the configuration provided with the second pressing means, the second pressing means acts in cooperation with the damping means to suppress rebounding of the pressing member from the surface of the paper roll and strengthens the pressing on the peripheral surface of the paper roll after the pressing member is made to collide with the paper roll by the first pressing means.

In related art 1 and related art 2, rebound preventing means acting to resist the rebounding operation are provided as means for suppressing the rebounding of the pressing member and the relationship between the amount of displacement and the elapsed time for the pressing member of the paper splicing device with this kind of configuration is shown in the graph in FIG. 8. FIG. 8 shows that the occurrence of rebounding is suppressed to a relatively short duration after the pressing member collides with the peripheral surface of the paper roll via the running paper web.

However, the impact force with which the pressing member first collides is not suppressed in any way and the reactive force proportional to the magnitude of the impact force therefore acts as is. The pressing member is therefore made to stop and there is therefore the problem that it takes a little time before the pressing force stabilizes to an appropriate amount. Therefore, during this time, the pressing force of the pressing member for pushing the running paper web onto the peripheral surface of the paper roll is inconsistent in strength, which causes paper splicing of the paper web and the lead edge of the paper roll to be defective. The impact due to the collision of the pressing member is directly applied to the running paper web and the peripheral surface of the rotatably driven paper roll and the tension of the paper web during running therefore rises rapidly causing instability. This causes the paper splicing to be unstable and causes the splicing precision to fall.

With the damping means disclosed in related art 2, the shaft of the coupling member supporting the pressing member is elastically deformed due to the force exerted from the running paper web while the pressing means is in contact with the running paper web and the elastically deformed portion is dampened by frictional resistance. There is also a problem that deformation of and damage to parts occurs more easily due to repeating a paper splicing operation where pressure is applied to the paper splicing device for every paper splicing operation, with the lifespan of the paper splicing device therefore falling as a result.

SUMMARY OF THE INVENTION

A paper splicing device with a pressing member for pressing running paper web taken from one paper roll against the surface of another paper roll rotatably driven in such a manner that the surface of the another roll moves at substantially the same speed as the running speed of the paper web, the paper splicing device comprising pressing means for pressing and actuating the pressing member and pressing the paper web against the surface of the paper roll; and at least one shock absorbing means, provided facing the direction of movement of a coupling member operated by pushing force due to the pressing means.

This paper splicing device may be provided with shock absorbing means constituted by fluid pressure cylinders, with output rods being pushed back by a coupling member as a result of a pushing operation of the pushing means. With this paper splicing device, the shock absorbing means may also be provided with pressure regulating means capable of regulating the pressure of fluid supplied to the fluid pressure cylinders and is capable of regulating resistance when the output rods are pushing back.

DETAILED DESCRIPTION OF THE PREFERRED EMBODIMENTS

Figure 1:
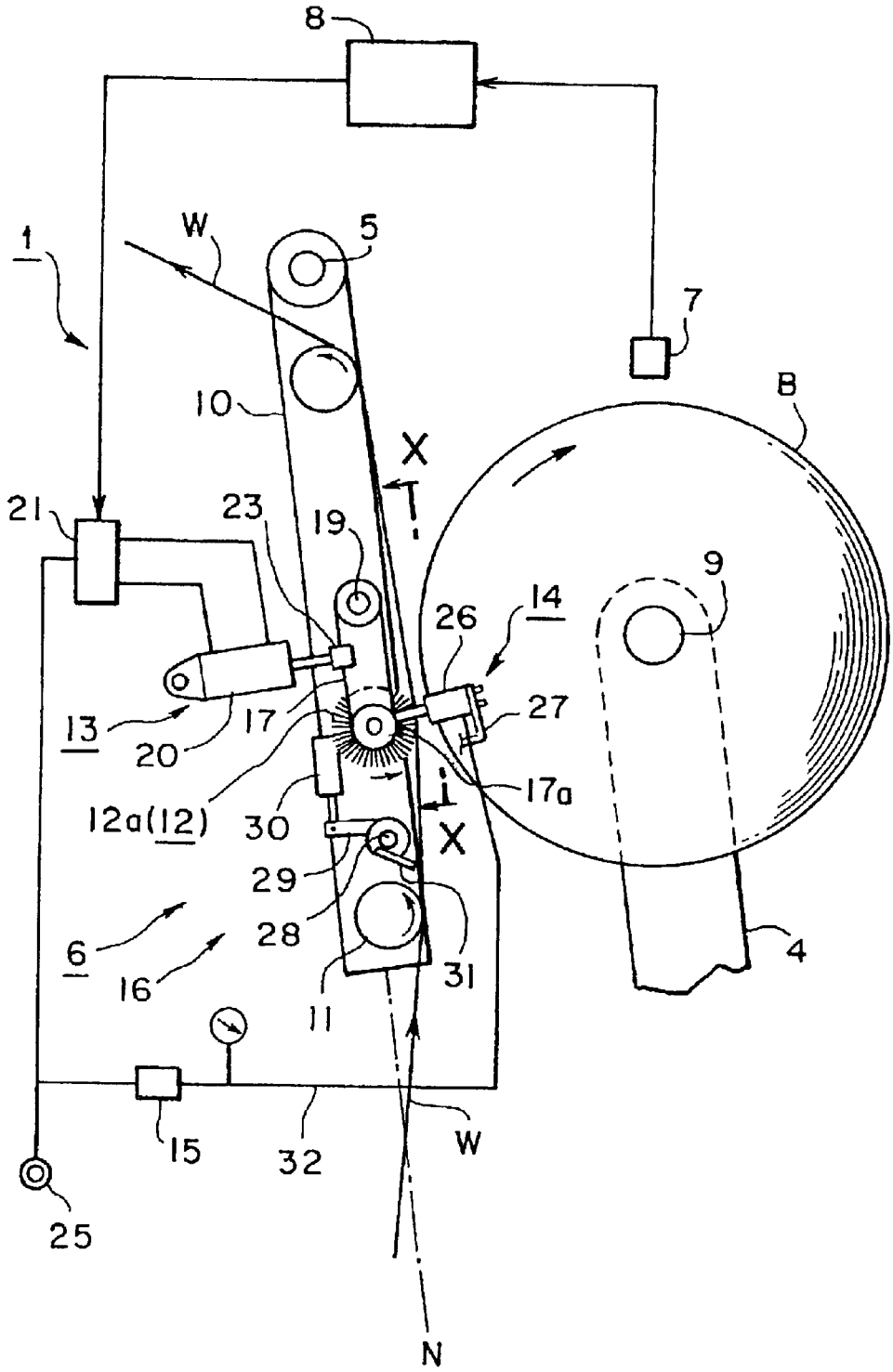
FIG. 1 is an outline view illustrating a paper splicing operation of a paper splicing device of a first embodiment of this invention.
Figure 2:
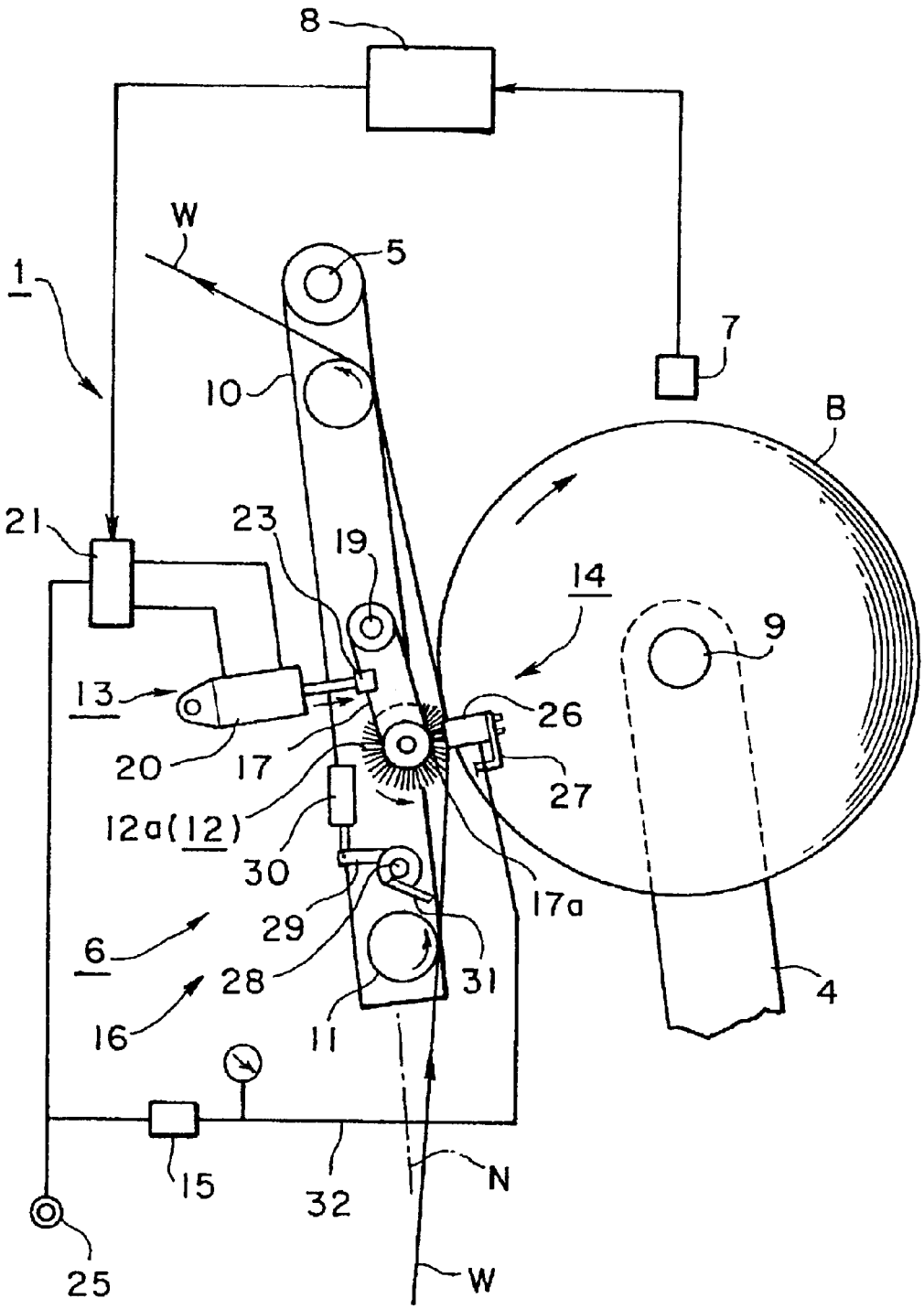
FIG. 2 is an outline view illustrating a paper splicing operation of a paper splicing device of a first embodiment of this invention.
Figure 3:
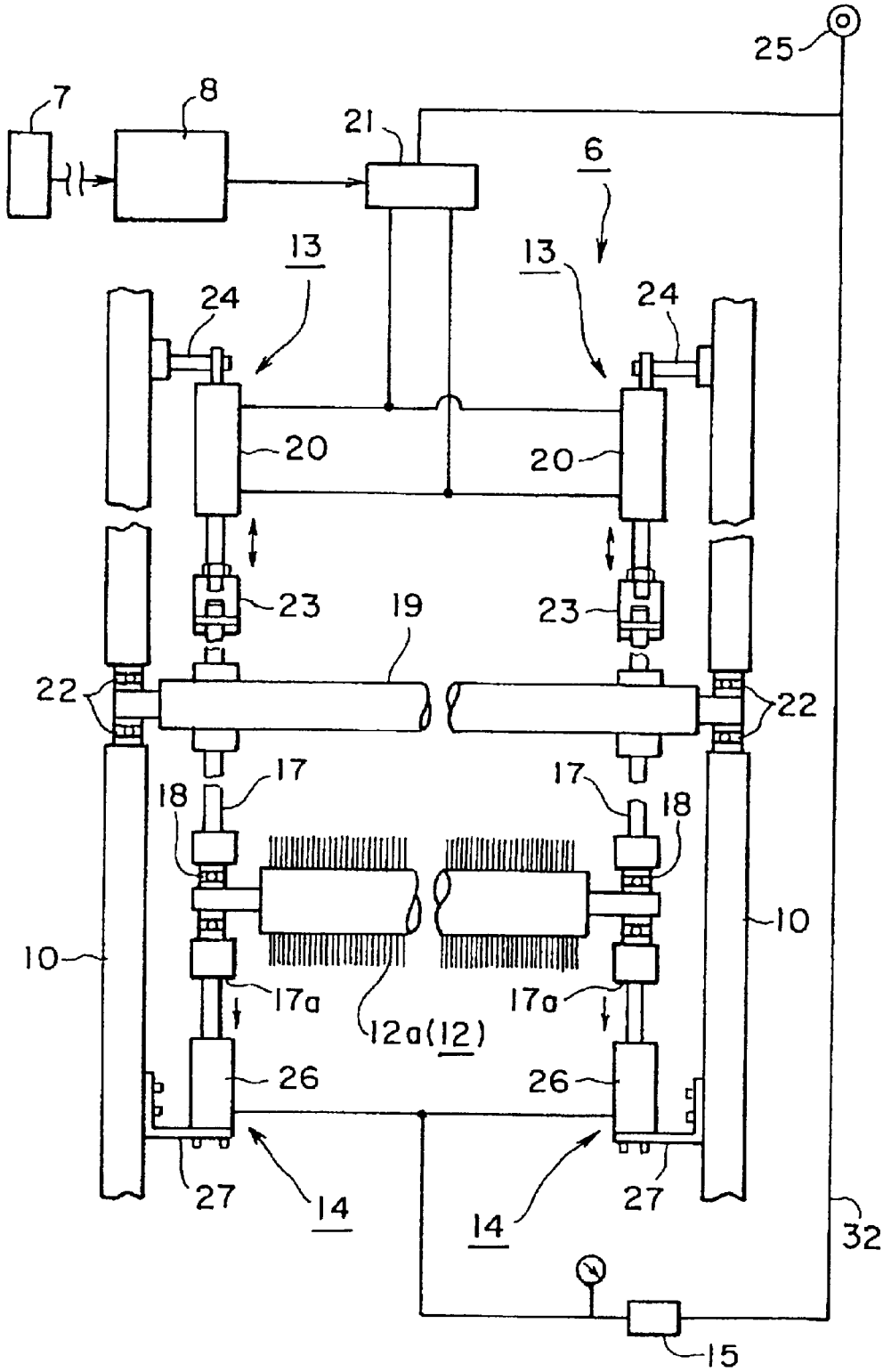
FIG. 3 is a cross-sectional developed view viewed along arrow XX of FIG. 1.
Figure 4:
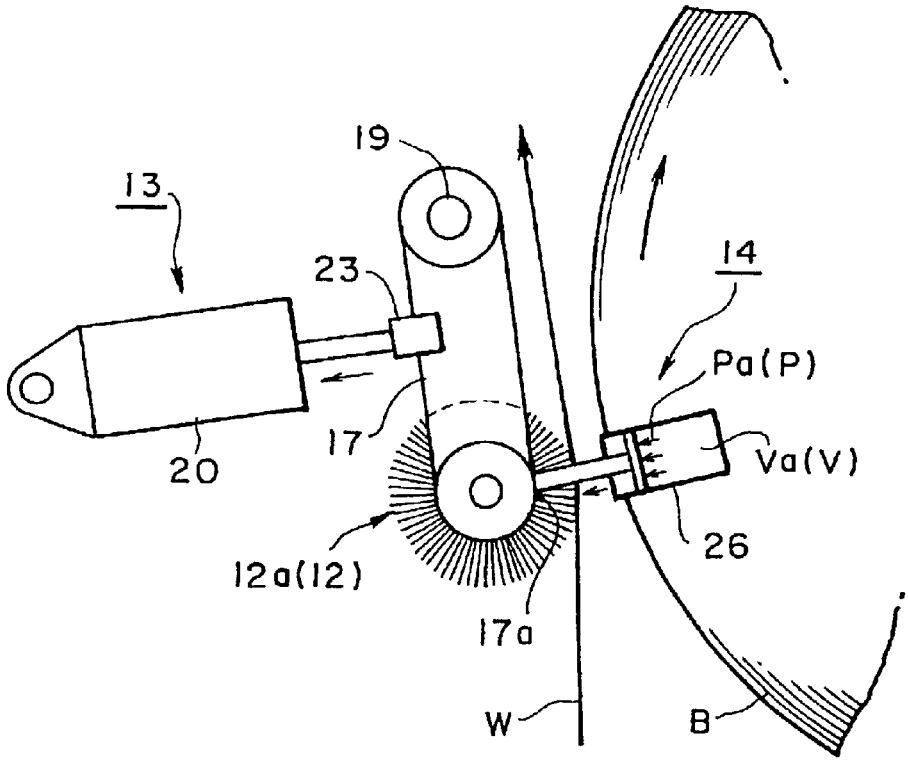
FIG. 4 is an outline operational view similarly showing an embodiment of this invention, showing the operation of a first fluid pressure cylinder (pressing means) and a second fluid pressure cylinder (shock absorbing means).
Figure 5:
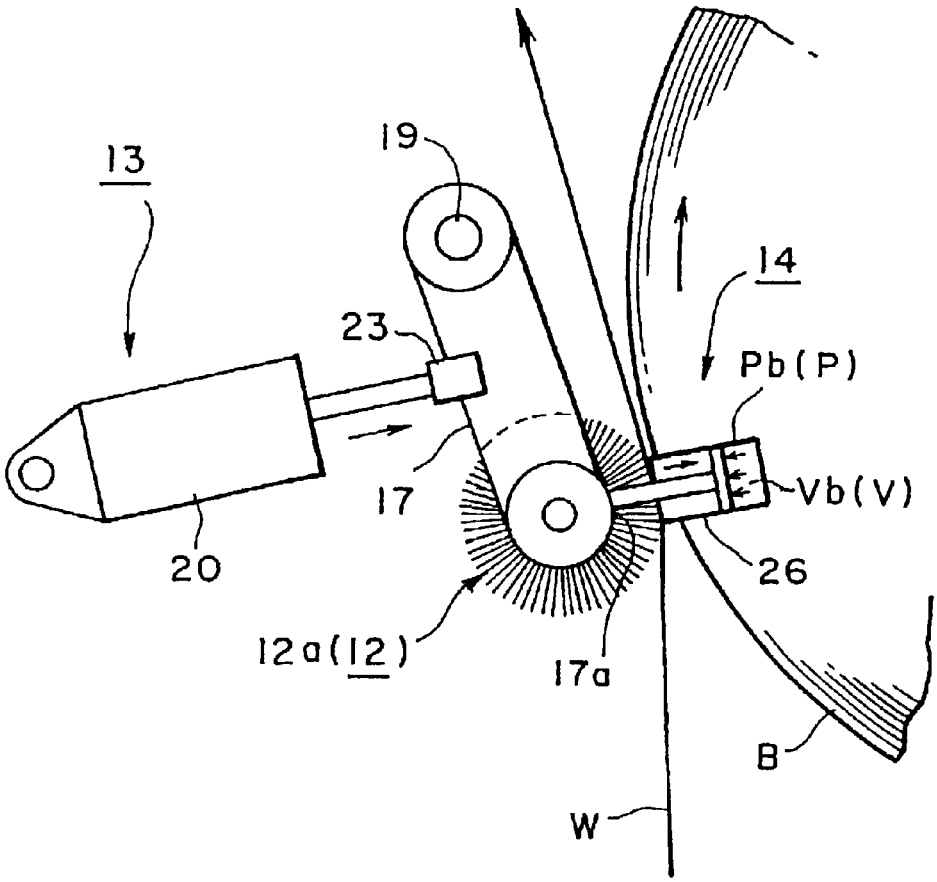
FIG. 5 is an outline operational view similarly showing an embodiment of this invention, showing the operation of a first fluid pressure cylinder (pressing means) and a second fluid pressure cylinder (shock absorbing means).
Figure 6:
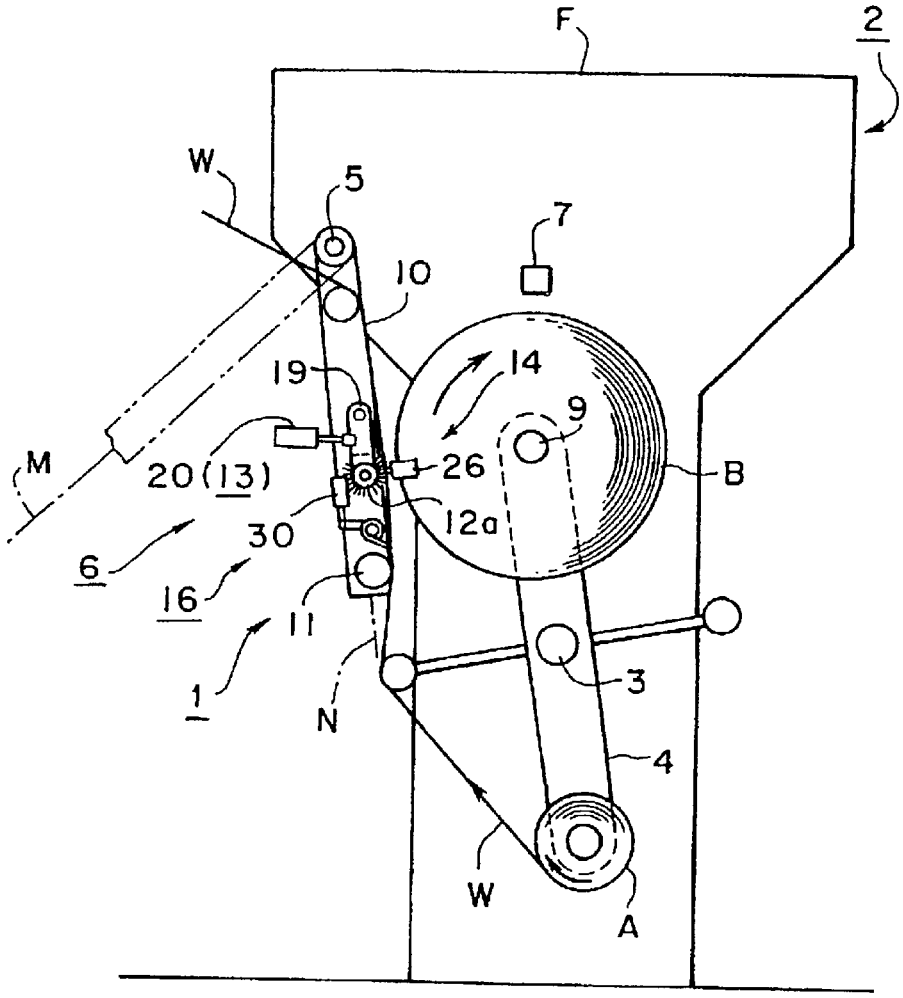
FIG. 6 is an outline view showing a paper feeder of a rotary press for the same embodiment of this invention.
Figure 7:
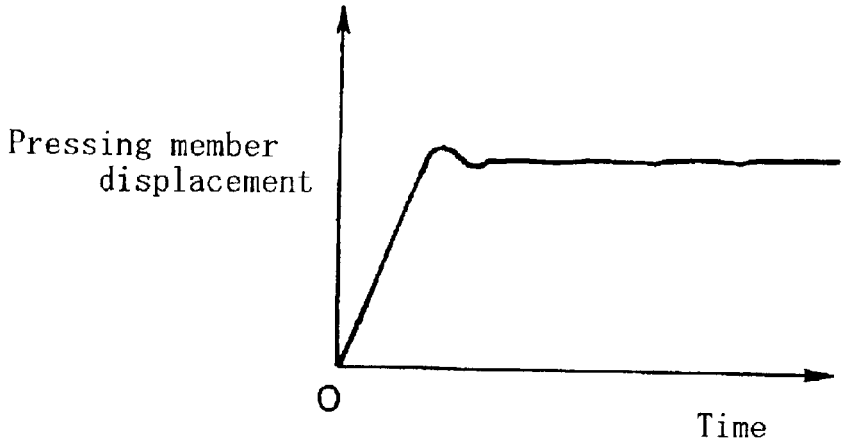
FIG. 7 is a graph showing the relationship between displacement and time elapsed for a pressing member of this invention.
Figure 8:
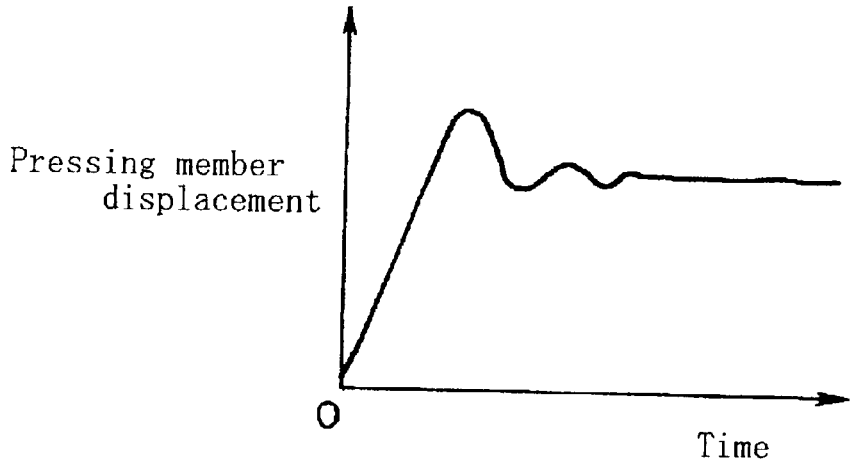
FIG. 8 is a graph showing the related art, and is a graph showing the relationship between displacement and time elapsed for a pressing member having rebounding prevention means.
Figure 9:
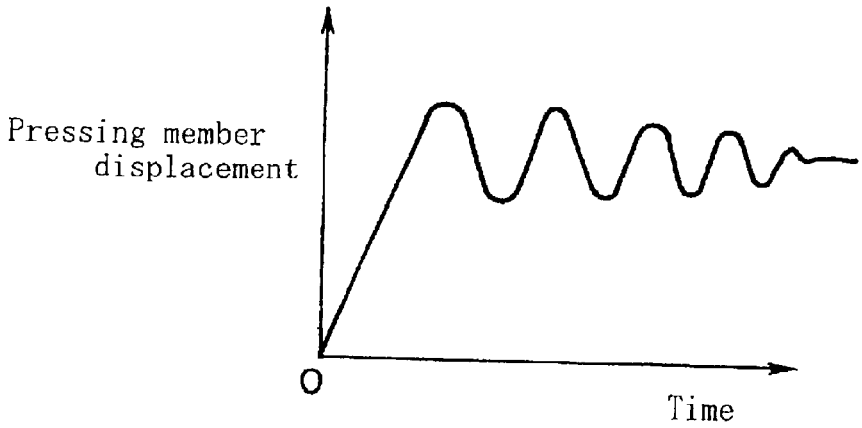
FIG. 9 is a graph showing the related art, and is a graph showing the relationship between displacement and time elapsed for a pressing member not having rebounding prevention means.

A description is now given based on FIG. 1 and FIG. 2 constituting outline illustrations showing the paper splicing operation of the paper splicing device of the first embodiment, FIG. 3 constituting a cross-section developed view viewed along line XX of FIG. 1, FIG. 4 and FIG. 5 that are outline operational views showing the operation of the first fluid pressure cylinder (pressing means) and a second fluid pressure cylinder (shock absorbing means), FIG. 6 constituting an outline view showing a paper feeder of a rotary press for the same embodiment of this invention, and FIG. 7 constituting a graph showing the relationship between displacement and time elapsed for a pressing member of this invention.

With a paper feeder 2 of a rotary press of this embodiment of the invention, a shaft 3 is rotatably supported between frames F and F (one of which is not shown) installed parallel to each other in a spaced manner as shown in FIG. 6. Two roll support arms 4, 4 (one of which is not shown) are fitted to the shaft 3 in a radial manner offset from each other by 180 degrees. Two paper rolls A and B are then supported so as to face the ends of the roll support arms 4, 4. Of the two paper rolls A and B, the paper roll A which has a reduced amount of paper is hereafter taken to be the expended paper roll A, and the fresh paper roll B for which paper is to be spliced is taken to be the fresh paper roll B from thereon. A paster arm shaft 5 is fixed between the frames F, F in parallel with the shaft 3 diagonally above the shaft 3. A paster arm unit 6 of the paper splicing device 1 is fitted to the paster arm shaft 5 so as to be capable of being angularly displaced taking the paster arm shaft 5 as a fulcrum. The paster arm unit 6 is fitted so as to be capable of reciprocal movement through angular displacement between a standby position M shown by the chain line in FIG. 6 and a paper splicing position N shown by solid lines taking the paster arm shaft 5 as a fulcrum by moving means (not shown).

The expended paper roll A is supported at one end of the roll support arms 4, 4 and running paper (paper web) W is pulled upwards from the expended paper roll A by a printing unit (not shown). The fresh take up roll B that has not yet been spliced is supported at the other end of the roll support arms 4, 4. Detecting means 7 constituted by an optical sensor for detecting the position of paper splicing on the peripheral surface of the roll is fixed in a direction facing downwards between the frames F, F using a bracket (not shown) above the fresh paper roll B. Signals detected by the detecting means 7 are transmitted to each part via control means 8.

The lead edge of the peripheral surface of the fresh paper roll B is temporarily tacked using tape etc. Pasting units for paper splicing are provided along the lead edge of the fresh paper roll B using adhesive such as double-sided adhesive tape etc. Detection elements such as black tape etc. having tacky surfaces are attached to the lead edge to enable paper splicing positions to be detected by the detecting means 7.

The fresh paper roll B is configured beforehand in such a manner as to be brought forward during paper splicing so as to be rotatably driven by an appropriate driving means 9 so that the peripheral surface moves at the same speed as the speed of the paper W running in a clockwise direction as in FIG. 6.

As shown in FIG. 1, FIG. 2 and FIG. 3, the paster arm units 6, 6 are fitted so as to be capable of being angularly displaced at the paster arm shaft 5 in such a manner that the paster arms 10, 10 (only one of which is shown in FIG. 1 and FIG. 2) face each other with a space in-between. The paster arms 10, 10 are provided in such a manner that rotatable guide rollers 11 for guiding the running paper W pulled from the expended paper roll A at a paper splicing position N are rotatably provided and the paster arm shaft 5 and a stay parallel with the paster arm shaft 5 are fixed. As a result, the pair of paster arms 10, 10 are integral so as to form the paster arm units 6.

A pressing member 12, pressing means 13, shock absorbing means 14, pressure regulating means 15 and cutting means 16 are provided at the paster arm unit 6.

In this embodiment, the pressing member 12 is comprised of a brush roller 12*a*, with hair being provided on the peripheral surface of the roller going outwards from the center of the brush, with the axial direction of the roller being wider than the width of the running paper W. The brush roller 12*a* is supported in a rotatable manner at both ends by pressing arms 17, 17 constituted by supporting members of the pressing means 13 via an end of the pressing arms 17, 17 and a bearing 18. The running paper W is pushed against the peripheral surface of the fresh paper roll B by pushing of the brush roller 12*a*. In a further embodiment of the pressing member 12, a sponge roller provided with a sponge at a peripheral surface of a roller may be provided as the pressing member 12, with pushing against the peripheral surface of the fresh paper roll B taking place via the running paper W using a brush with hair provided at a plate.

The pressing means 13 comprises pressing arms 17, 17, a shaft 19, first fluid pressure cylinders 20, 20, and an electromagnetic switching valve 21. The pressing arms 17, 17 are supporting members for supporting both ends of the shaft for the brush roller 12*a* in a rotatable manner. The shaft 19 is fixed at the other end of the pressing arms 17, 17, and both ends of the shaft are supported at paster arms 10, 10 positioned at both sides via bearings 22, 22 in a rotatable manner.

In this embodiment, the first fluid pressure cylinders 20, 20 comprise first air cylinders, coupled with knuckles 23, 23 provided at the tips of output rods in the center of the pressing arms 17, 17, and are supported by brackets 24, 24 fitted to the paster arms 10, 10. The electromagnetic switching valve 21 is provided at piping between the first air cylinders 20, 20 and an air supply 25 and acts to change between advancing and retracting the output rods of the first air cylinder 20, 20. The shaft 19 and the pressing arms 17, 17 are angularly displaced taking the center of the shaft 19 as a fulcrum as a result of pushing or pulling of the pressing arms 17, 17 by the knuckles 23, 23 as a result of the output rods of the first air cylinders 20, 20 extending and retracting. The brush roller 12*a* supported by one of the pressing arms 17, 17 then moves closer to or further away from the peripheral surface of the fresh paper roll B due to the angular displacement of the pressing arms 17, 17.

The paper splicing operation of the pressing means 12 due to the pressing means 13 is such that the electromagnetic switching valve 21 receiving the signal from the control means 8 operates so that the output rods activate the first air cylinders 20, 20 retracted to the standby position, and the output rods therefore extend. The pressing arms 17, 17 are therefore pressed due to the extension of the output rods and the shaft 19 is rapidly angularly displaced. In accompaniment with this, the pressing arms 17, 17 are angularly displaced centrally about the axial center of the shaft 19, the brush roller 12*a* of the pressing member 12 is rapidly caused to move, and the running paper W that is being consumed presses against the peripheral surface of the fresh paper roll B and paper splicing is performed. When paper splicing is complete, the electromagnetic switching valve 21 receiving a signal from the control means 8 switches over, and the output rods of the first air cylinders 20, 20 are retracted and returned to a standby position. The pressing arms 17, 17 are then pulled due to retraction of the output rods, and, as a result of angular displacement of the shaft 19, the brush roller 12*a* of the pressing member 12 is moved to the standby position as a result of angular displacement of the pressing arms 17, 17 centrally about the shaft center of the shalt 19.

Instead of the first air cylinders 20, 20, the pressing means 13 is also provided with a torsion spring (not shown) surrounding the shaft 19, with fitting being possible in such a matter that the spring force of the torsion spring is transmitted to the pressing arms 17, 17. In the embodiment employing a torsion spring, the brush roller 12*a* of the pressing member 12 is made to move by angular displacement of the shaft 19 and the pressing arms 17, 17 centrally about the axial center of the shaft 19 of the pressing arms 17, 17 as a result of the spring force of the torsion spring so that the running paper W being consumed is pushed against the peripheral surface of the fresh paper roll B and paper splicing is carried out.

The shock absorbing means 14 comprises second fluid pressure cylinders 26, 26 and in this embodiment these are second air cylinders 26, 26. The second air cylinders 26, 26 apply fluid pressure in the direction in which the output rods extend. In the standby position for the pressing means 13 with the output rods of the first air cylinders 20, 20 of the pressing means 13 retracted, the tips of the output rods extending at the outer surfaces 17*a*, 17*a* of the pressing arms supporting the brush roller 12*a* are in contact or in very close proximity to the brush roller 12*a* and the ends of the output rods face the operation of the brush roller 12*a* during paper splicing. The second air cylinders 26, 26 are fitted to brackets 27, 27 fitted to the paster arms 10, 10 respectively so as to be subject to the operation of the pressing arms 17, 17 that move the brush roller 12*a* during paper splicing.

When the brush roller 12*a* constituting the pressing member 12, the pressing arm 17 and the shaft 19 are angularly displaced centrally about the axial center of the shaft 19 due to the extension of the output rod of the first air cylinder 20 of the pressing means 13 as shown in FIG. 4 and FIG. 5, the output rod of the second air cylinder 26 of the shock absorbing means 14 is pushed against the outer surface 17*a* of the pressing arm 17 and retracts. The piston of the second air cylinder 26 at this time works as a cushion while retracting.

Taking internal pressure on the piston to be P and the volume of gas compressed by the piston to be V within the cylinder of the second air cylinder 26, the cushioning operation of the second air cylinder 26 is such that while the product of P and V is fixed, the temperature remains constant and Boyles law is obeyed. Namely, PaVa=PbVb is fulfilled within the cylinder at the time of extension and retraction of the output rod of the second air cylinder 26 shown in FIG. 4 and FIG. 5. Here, Pa indicates the pressure within the cylinder acting on the piston from the rear side of the output rod when the brush roller 5*a* is in the standby position and the output rod of the second air cylinder 26 is extended. Va is the volume of gas within the cylinder at the back surface of the output rod taking the piston as a boundary at this time. Further, Pb indicates the pressure within the cylinder acting on the piston from the rear side of the output rods when the output rods of the second air cylinders 26 are retracted at an appropriate time in the process where the brush roller 12*a* is moved by the pressing means 13 so that the running paper W is pushed onto the peripheral surface of the fresh paper roll B. Vb is the volume of gas within the cylinder at the back surface of the output rod taking the piston as a boundary at this time.

During extension of the output rods of the second air cylinders 26 shown in FIG. 4, a low pressure Pa acts on the piston and the volume Va is at a maximum. At this time, the tip of the output rod and the brush roller 12*a* are connected or in close proximity without the pressure Pa acting on the brush roller 12*a*. The outer surface 17*a* of the pressing arm 17 supporting the brush roller 12*a* presses against the output rod of the second air cylinder 26 of the shock absorbing means 14 due to the first air cylinder 20 of the pressing means 13 operating so that the output rod extends, as shown in FIG. 5. The output rod and the piston move in a right direction in FIG. 5 within the cylinder of the second air cylinder 26, and the volume at the back side of the output rods that the piston takes as a boundary is small at Vb, and the pressure Pb acting on the piston from the back side of the output rod is inversely proportional to the volume Vb and is therefore high.

When the output rod of the second air cylinder 26 is rapidly pushed by the outer surface 17*a* of the pressing arm 17 supporting the brush roller 12*a*, the internal pressure P that is the resistance of the second air cylinder 26 is low at first but rises rapidly. Namely, at first, the moving speed of the brush roller 12*a* is not particularly influenced and therefore movement does not become slow because the resistance of the second air cylinder 26 (shock absorbing means 14) is small. However, the volume at the back surface of the output rod within the cylinder of the second air cylinder 26 becomes small at Vb in accompaniment with this movement, the pressure Pb acting on the piston from the back surface of the output rods is inversely proportional to the volume Vb and therefore becomes large, and the pressure Pb reaches a maximum just before pushing of the running paper W onto the peripheral surface of the fresh paper roll B by the brush roller 12*a*. A cushioning operation is carried out by this maximum pressure Pb and when the brush roller 12*a* collides with the peripheral surface of the fresh paper roll B, the force of this impact is absorbed. Rebounding of the brush roller 12*a* due to reactive force with respect to the collision force is therefore eliminated altogether or kept very slight.

Further, with a further embodiment of the shock absorbing means 14, a shock absorber such as an oil damper is used in place of the second air cylinder 26 and is fitted in such a manner as to act just before the brush roller 12*a* presses against the peripheral surface of the fresh paper roll B via the running paper W so as to absorb the impact force due to the collision with the brush roller 12*a*.

The pressure regulating means 15 is provided at an appropriate position at air piping 32 linking the air supply 25 and the second air cylinder 26. The pressure regulating means 15 regulates the backpressure P of the piston by regulating the pressure of the air supply to within the cylinder of the second air cylinder 26, and is capable of regulating a cushioning operation for absorbing the impact force when the brush roller 12*a* collides with the running paper W at the peripheral surface of the fresh paper roll B. The pressure regulating means 15 is constructed so as to prevent reverse air flow.

The cutting means 16 is provided at a position below the brush roller 12*a* within the paster arm units 6 so that the shaft 28 is rotatably supported by the paster arms 10, 10. One end of each arms 29, 29 is fixed to either end of the shaft 28, with third fluid pressure cylinders 30, 30 fixed to the paster arms 10, 10 being linked to the other ends of the arms. In this embodiment, the third fluid pressure cylinders 30, 30 are constituted by third air cylinders 30, 30. Further, a cutter 31 equipped with a blade with a serrated edge running along the shaft 28 is fitted between the paster arms 10, 10 of the shaft 28 so that the blade projects from the shaft 28 pointing downwards at an incline from the running paper W. With the operation of the cutting means 16 during paper splicing, an electromagnetic switching valve (not shown) receiving the signal from the control means 8 operates so that the output rods activate the third air cylinders 30, 30 retracted to the standby position, and by then extending the output rods, the shaft 28 is angularly displaced centrally about the shaft center so that the cutter 31 fitted to the shaft 28 is made to move.

Further, when the splicing operation is complete, an electromagnetic switching valve (not shown) receiving the signal from the control means 8 is switched over to and operated so that by conversely retracting the output rods of the third air cylinders 30, 30, the shaft 28 is angularly displaced centrally about the shaft center and the cutter 31 fitted to the shaft 28 is made to move to the standby position.

Next, a description is given of the operation of the paper splicing device 1 of this embodiment.

In FIG. 6, as consumption of running paper W from the expended paper roll A progresses, the paster arm unit 6 is moved by the moving means (not shown) from a standby position M to a paper splicing position N and is stopped. At the paper splicing position N, the guide roller 11 and brush roller 12*a* of the pressing member 12 within the paster arm unit 6 come into contact with the running paper W, and rotational driving takes place in such a manner that the speeds of the peripheral surface of the guide roller 11 and the brush roller 12*a* become slower than the running speed of the running paper W due to surface friction of the running paper. The driving means 9 is then activated, and the fresh paper roll B rotates at substantially the same peripheral surface speed as the running speed of the running paper W.

(2) When the roll diameter of the expended paper roll A reaches a specified diameter during paper splicing, the detecting means 7 detects detection elements made of black tape having tackiness at the surface affixed to the lead edge of the fresh paper roll B and a detection signal is generated. When the detection signal from the detecting means 7 is received by the control means 8, the control means 8, either immediately or prior to the detection elements of the fresh paper roll B reaching the paper splicing position at which the brush roller 12*a* acts, sends an activation signal to the electromagnetic switching valve 21 so that it is possible for the brush roller 12*a* to push the running paper W against the surface of the fresh paper roll B.

(3) When the electromagnetic switching valve 21 receives the activation signal from the control means 8, a valve is switched over, the first air cylinders 20, 20 are activated and the output rods retracted to the standby position are rapidly extended, as shown in FIG. 2. When the output rods of the first air cylinders 20, 20 extend, the shaft 19 and pressing arms 17, 17 are angularly displaced centrally about the shaft center of the shaft 19, and the brush roller 12*a* supported at the pressing arms 17, 17 moves rapidly. The running paper W running due to the moving brush roller 12*a* therefore pushes against the surface of the fresh paper roll B rotating at substantially the same speed as the running speed of the running paper W. At this time, outer surfaces 17*a*, 17*a* of the pressing arms 17, 17 supporting the brush roller 12*a* also move in accompaniment with the movement of the brush roller 12*a*, and the tips of the extending output rods of the second air cylinders 26, 26 constituting the shock absorbing means 14 are pressed by the outer surfaces 17*a*, 17*a* and the output rods therefore retract. The second air cylinders 26, 26 act to cushion the impact force due to the collision of the brush roller 12*a* and the fresh paper roll B and the output rods of the second air cylinders 26, 26 offer increased resistance in proportion to the increase in the amount of change of the outer surfaces 17*a*, 17*a* of the pressing arms 17, 17 pressed by the output rods. The brush roller 12*a* that is moving rapidly due to the first air cylinders 20, 20 constituting the pressing means 13 is suppressed by resistance within the second air cylinders 26, 26 that is rapidly increasing and therefore collides with the surface of the fresh paper roll B via the running paper W with an appropriate amount of force and the running paper W than presses against the surface of the fresh paper roll B with an appropriate amount of pressing force.

(4) When the running paper W is pressed against the peripheral surface of the fresh paper roll B by the brush roller 12*a*, the lead edge of the fresh paper roll B is spliced to the surface of the running paper W by the pasting units and the black tape with a surface having tackiness at the surface provided at the lead edge for paper splicing and paper web is then pulled from the fresh paper roll B. Paper web pulled from the fresh paper roll B is then overlapped with running paper W pulled from the expended paper roll A and is made to run in a downstream direction.

(5) Next, a signal is generated from the control means 8 at an appropriate timing, and the third air cylinders 30, 30 of the cutting means 16 are activated. When the output rods of the third air cylinders 30, 30 extend, the shaft 28 angularly rotates centered about the shaft center, the cutter 31 moves, and the tip of the blade of the cutter 31 cuts the running paper W pulled from the expended paper roll A.

(6) The splicing then ends, an excitation release signal is generated by the control means 8, the electromagnetic switching valve 21 receiving the signal is switched over, the third air cylinders 30, 30 are actuated, and an electromagnetic switching valve (not shown) is switched over. As a result of switching over valves of the two electromagnetic switching valves, the output rods of the first air cylinders 20, 20 retract, the brush roller 12*a* moves to the standby position and is housed within the paster arm unit 6. The output rods of the third air cylinders 30, 30 also retract and the cutter 31 is moved to the standby position and housed in the paster arm unit 6.

(7) The paster arm unit 6 is then moved by the moving means (not shown) from the paper splicing position N to the standby position M while at substantially the same time, driving of the rotatably driven means 9 for rotatably driving the fresh paper roll B is stopped. The paper splicing operation of the paper splicing device 1 of this invention is then complete.

In the above, the speed of movement of the brush roller 12*a* constituting the pressing member that makes contact by pressing on the running paper W at the peripheral surface of the fresh paper roll B due to the action of the pressing means 13 is dampened by the cushioning action of the second air cylinders 26, 26 of the shock absorbing means 14 just before making contact with the peripheral surface of the fresh paper roll B via the running paper W. There is therefore no impact when contact is made with the peripheral surface of the fresh paper roll B at high speed or the collision is absorbed, stopping takes place at an appropriate pressing force and pressing position, and paper splicing is reliably performed using pasting units and detection units provided at the lead edge of the fresh paper roll B.

The invention therefore has the following effects.

(1) The impact force when the pressing member collides with the surface of the paper roll via the paper web is absorbed and kept to a minimum, or is kept extremely small when compared with the related art. It is therefore possible to eliminate a rebounding action due to the impact force when the pressing member collides with the surface, or keep this rebounding action extremely small.

(2) It is therefore anticipated that the pressing force for pressing the currently running paper web onto the peripheral surface of the paper roll during paper splicing can be kept at a steady level. The splicing of the paper web currently running and the lead edge of the fresh paper roll can therefore be performed in a reliable manner and splicing precision is improved.

(3) Further, there is no impact caused between the paper web currently running and the surface of the rotatably driven paper roller due to the movement of the pressing member. The tension of the currently running paper web can therefore be kept stable and reliable paper spicing is possible.

(4) The impact force due to the impact of the pressing member with the peripheral surface of the paper roll is absorbed. The impact exerted on the whole of the paper splicing device is therefore absorbed, the amount of maintenance work required on the whole of the device is reduced, and the lifespan of the device itself is prolonged.

(5) Further, a pressure regulating device is provided so that it is possible to regulate the pressure supplied to the fluid pressure cylinders constituting the shock absorbing means. The resistance of the shock absorbing means can therefore be regulated, and the impact force due to the colliding of the pressing member and the surface of the paper roll can be appropriately reduced and absorbed.

What is claimed is:

1. A paper splicing device, comprising:

a presser adapted to impart a pressing force onto a running paper web taken from one paper roll against a peripheral surface of another paper roll so that paper is spliced;

an actuator adapted to move the presser from a first position to a second position, the second position being a position where the presser imparts the pressing force onto the running paper, wherein the actuator is further adapted to move the presser such that a maximum presser velocity is attained while the presser is moved from the first position to the second position; and a shock absorber adapted to slow the movement of the presser from a first velocity that is equal to or less than the maximum presser velocity to a second velocity lower than the first velocity as the presser approaches the second position.

2. The paper splicing device of claim 1, wherein the paper splicing device is adapted so that that the presser does not impart the pressing force when the presser is at the first position.

3. The paper splicing device of claim 1, wherein the presser is a brush roller.

4. A paper splicing device, comprising:

a presser adapted to impart a pressing force onto a running paper web taken from one paper roll against a peripheral surface of another paper roll so that paper is spliced;

an actuator adapted to move the presser from a first position to a second position, the second position being a position where the presser imparts the pressing force onto the running paper; and a shock absorber adapted to impart resistance against movement of the presser, the shock absorber being further adapted to increase the imparted resistance as the presser moves from at least one of (a) the first position and (b) a third position in-between the first position and the second position.

5. The paper splicing device of claim 4, wherein the shock absorber is adapted to increase the imparted resistance as a result of a rapid increase in pressure of a working fluid inside the shock absorber.

6. The paper splicing device of claim 5, wherein the pressure of the working fluid reaches a maximum just before the presser reaches the second position.

7. The paper splicing device of claim 5, wherein the shock absorber is further adapted to reduce kinetic energy of the presser from a maximum kinetic energy previously obtained by the presser prior to reaching the second position.

* * * * *